United States Patent [19]

Rubino

[11] Patent Number: 4,954,116

[45] Date of Patent: Sep. 4, 1990

[54] HAND-SPINNABLE TOP AND KIT THEREFOR

[76] Inventor: John Rubino, R.D. 2, Box 2721, Stowe, Vt. 08572

[21] Appl. No.: 328,180

[22] Filed: Mar. 24, 1989

Related U.S. Application Data

[63] Continuation of Ser. No. 82,109, Aug. 6, 1978, abandoned.

[51] Int. Cl.[5] ..... A63H 1/00

[52] U.S. Cl. ..... 446/256; 446/76; 446/264

[58] Field of Search ..... 446/75, 76, 77, 256, 446/257, 258, 259, 260, 261, 262, 263, 264; 273/434; 81/466

[56] References Cited

U.S. PATENT DOCUMENTS

| | | | |
|---|---|---|---|
| 521,148 | 6/1894 | Barr, Jr. | 446/264 |
| 685,311 | 10/1901 | Ward | 446/264 |
| 788,041 | 4/1905 | Fultz | 446/258 |
| 1,164,991 | 12/1915 | Conklin | 446/264 |
| 1,587,766 | 6/1926 | English | 446/263 |
| 1,609,336 | 12/1926 | Ward | 446/262 |
| 2,906,057 | 9/1959 | Sullivan | 446/256 |
| 3,236,002 | 2/1966 | Cunningham | 446/76 |
| 3,544,113 | 1/1970 | Hand | 273/424 |
| 4,364,440 | 12/1982 | Clar | 81/466 |
| 4,527,688 | 7/1985 | Jones | 446/76 |

*Primary Examiner*—Robert A. Hafer
*Assistant Examiner*—Michael Brown
*Attorney, Agent, or Firm*—Hopgood, Calimafde, Kalil, Blaustein & Judlowe

[57] ABSTRACT

A spinnable top comprises a flywheel component and a spindle component which are readily adapted to assembly and disassembly by reason of mutually threaded engagement to a shoulder stop. As a kit, these component parts and a wrench component, for use in torquing the assembly and/or disassembly, are retained in the base of a two-part thin cylindrical container; the other part of the container is a selectively removable cover which is configurated as a concave area by means of which each run of the top can be limited.

14 Claims, 2 Drawing Sheets

HAND-SPINNABLE TOP AND KIT THEREFOR

This is a continuation of copending application Ser. No. 082,109, filed Aug. 6, 1987, now abandoned.

BACKGROUND OF THE INVENTION

The invention relates to a spinnable top construction wherein flywheel and spindle components are separable, and to a kit and container for the same. Specifically, the top is of hand-driven variety, being to a degree devised as a challenge to the dexterity of the user.

Conventional hand-spun top construction calls for a spindle that is permanently fixed in its assembly to the flywheel or body portion of the top. And in some varieties, the body is mounted for rotation or for other motion with respect to all or part of the spindle. Patents illustrative of the state of the art are:

| | | |
|---|---|---|
| 93,760 | Sparks | 1869 |
| 541,802 | Barus | 1895 |
| 815,591 | Jones | 1906 |
| 1,046,657 | Schmidt | 1912 |
| 1,139,119 | Heidenreich | 1915 |
| 1,164,991 | Conklin | 1915 |
| 1,262,061 | Kristofek | 1918 |
| 3,083,498 | Kelley | 1963 |
| 3,191,341 | Martin | 1965 |

BRIEF STATEMENT OF THE INVENTION

It is an object of the invention to provide an improved hand-spinnable top construction wherein spindle and flywheel components are separate and are selectively assembled and disassembled, all for inclusion in a kit in the nature of an executive toy, as for desk-top contemplation and use.

Another object is to meet the above object in a kit configuration wherein the container for the separable parts also provides a surface for limiting the orbit or other path of spindle-axis movement in the course of a given spinning run of the top.

The invention achieves these objects in a configuration in which a flywheel component and a spindle component are readily adapted to assembly and disassembly by reason of mutually threaded engagement to a shoulder stop. As a kit, these component parts and a wrench component, for use in torquing the assembly and/or disassambly, are retained in the base of a two-part thin clyindrical container; and other part of the container is a selectively removable cover which is configurated as a concave area by means of which each run of the top can be limited.

DETAILED DESCRIPTION

The invention will be illustratively described in detail in conjunction with the accompanying drawings, in which.

Figure 1:
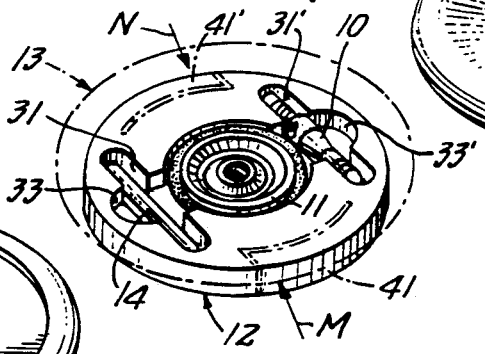
FIG. 1 is a perspective view of the kit of the invention, with its cover removed but suggested by phantom outline.
Figure 2:
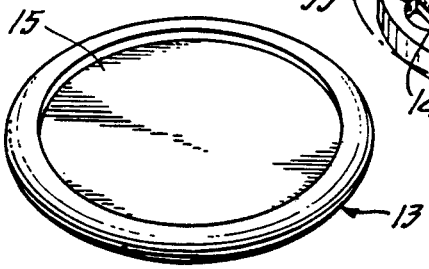
FIGS. 2 and 3 are similar perspective views of the cover, respectively for the inside and outside aspects thereof, the scale of FIGS. 1, 2, and 3 being the same.
Figure 3:
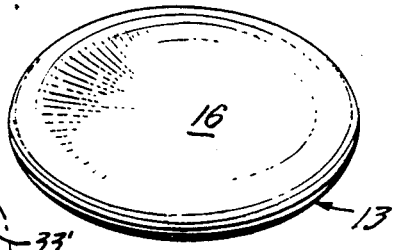
Figure 9:
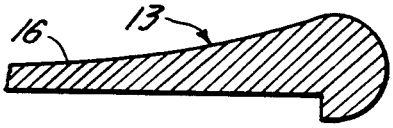
Figure 4A:
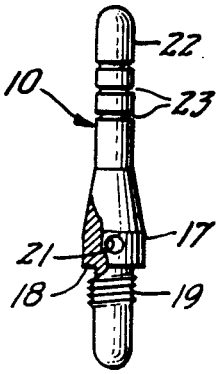
Figure 4B:
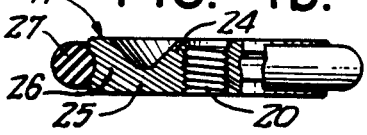
Figure 5:
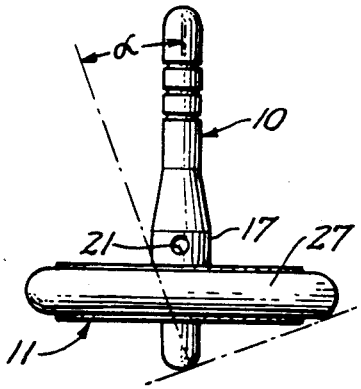
Figure 6:
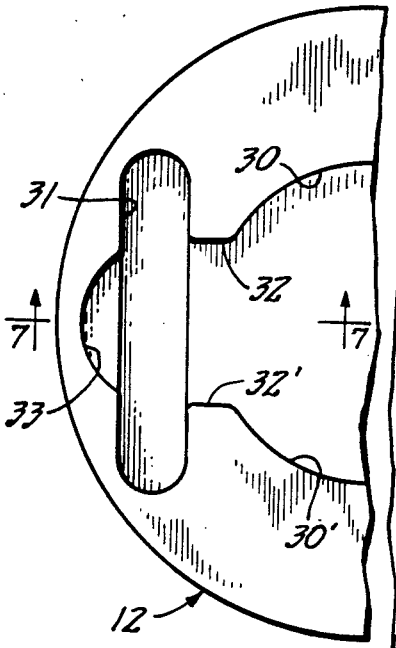
Figure 8:
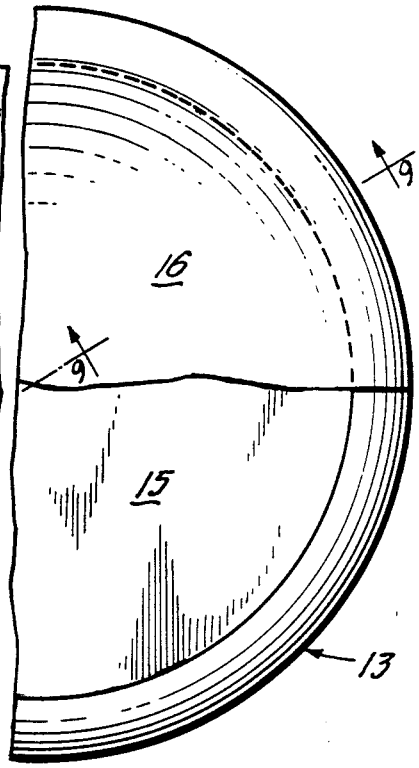
Figure 7:
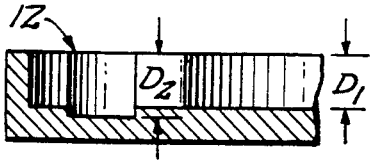
Figure 10:
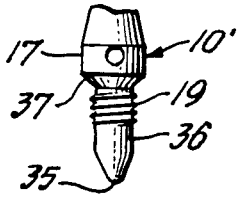

FIGS. 4*a* and 4*b* are views in elevation, on enlarged scale, to separately show a spindle component and a fly-wheel component of the kit of FIG. 1, parts being broken-away and in section;

FIG. 5 is a view in elevation of the components of FIGS. 4*a* and 4*b* in assembled relation;

FIGS. 6 and 7, respectively, are fragmentary plan and section views of the base part of the container of FIG. 1, the same being to teh same scale as FIGS. 4 and 5, and FIG. 7 being taken at 7—7 of FIG. 6;

FIGS. 8 and 9, respectively, are fragmentary plan and section views of the cover part of said container, the same being also to the scale of FIGS. 4 and 5, FIG. 8 being broken-away to show top-plan and bottom-plan aspects, and FIG. 9 being taken at 9—9 of FIG. 8;

FIG. 10 is a fragmentary view in elevation to show modification of FIG. 4*a*.

Figure 11:
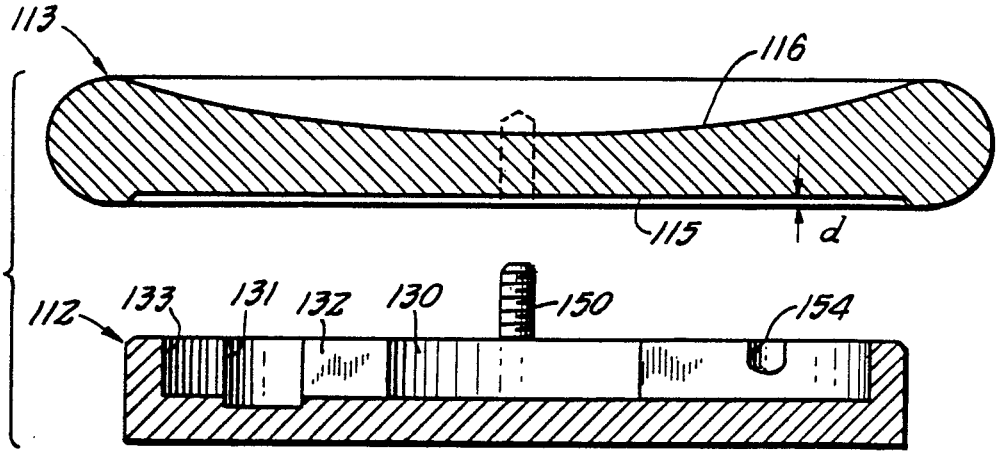
Figure 12:
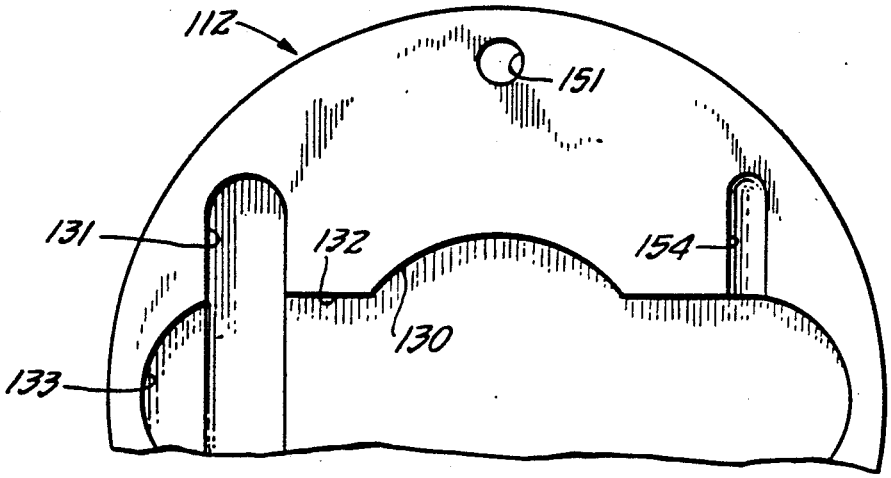

FIG. 11 is an exploded vertical section of top and bottom parts of a modified container;

FIG. 12 is a fragmentary plan view of the bottom part of FIG. 11; and

Figure 13:
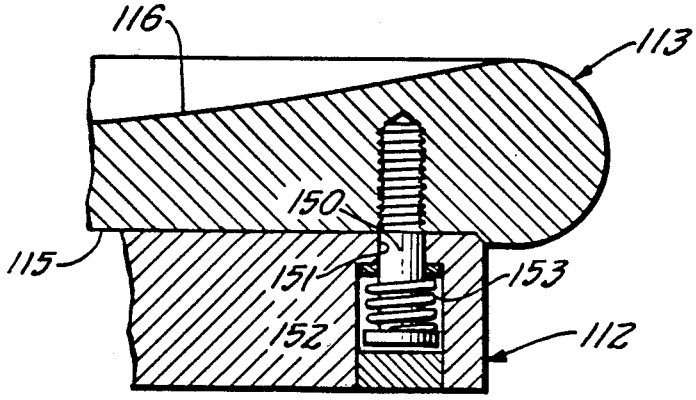

FIG. 13 is an enlarged fragmentary sectional view of the assembled connection of the parts of FIG. 11.

The top of the invention comprises separable spindle (10) and flywheel (11) components which are seen in FIG. 1 to be in individually nested array within retaining-recess formations in the otherwise flat upper surface of the base member 12 of a two-part container 12/13. To reveal the nested retention of components 10–11, plus a wrenching tool 14, the container cover 15 appears in FIG. 1 as a phantom outline. The base 12 is relatively thin and generally cylindrical, and the cover 13 is also relatively thin, being formed with a shallow flat cylindrical recess 15 on its underside, for selective friction engagement with the periphery of base 12, while its upper surface is a concave dish 16. Details of container construction will follow a description of top components.

As seen in FIGS. 4*a* and 4*b*, the spindle component 10 has an enlarged hub portion 17 which terminates in a downwardly facing shoulder 18. Below shoulder 18 is a threaded portion 19, via which the threaded bore 20 of the flywheel component 11 is selectively driven into or out of assembled abutment with shoulder 18. Below its threads 19, spindle 10 is smoothly cylindrical, at reduced radius, terminating in a convex semi spherical end which is circumferentially tangent to the reduced cylinder. The hub portion 17 is formed for wrench engagement, which for the case of accommodating the straight-pin tool 14 (FIG. 1) need only be a straight diametrically extending bore 21 through hub portion 17. Above the wrench bore 21, spindle 10 tapers down to a smooth cylindrical upper-end half 22, which terminates in an upper convex semi spherical end and is interrupted only by spaced circumferential grooves 23 which aid in manually torqued launching of a top spin.

The flywheel component 11 is characterized by an annular recess in its upper face, whereby a central hub portion 24 (with threaded bore 20) is connected by an intermediate web portion 25 to an outer, relatively massive annulus 26 which is circumferentially grooved for retention of an elastomeric O-ring 27. Frustoconical walls of the annular recess provide transition of web portion 25 to the respective thick inner and outer annular portions 24–26 of the flywheel component. As best seen in FIG. 5, the dimensional proportions of the parts are such that in an at-rest position, the assembled top will contact a concave running surface, such as the sectional profile 16 of cover 13, only via the lower end of the spindle and the elastomeric ring 27, thus assuring against scratching the surface 16 (or a flat running surface, such as a desk top) when a spinning top loses its spinning equilibrium.

The threaded bore 20 is seen to terminate at both ends with like chamfers, and it will be understood that on wrenched assembly to the square shoulder 18, a circumferentially continuous flat annular area of the flywheel achieves accurate and uniformly distributed engagement with shoulder 18, whether the assembly is such as to place web 25 on the underside (facing down) or on the upper side (facing up). This ability to reversibly assemble the flywheel to the spindle will be seen to afford a measure of different challenges for top-spin performance, in that the center of gravity of the flywheel is thereby selectively positioned at different offsets from the end point of spin contact with a supporting surface, such as the concave surface 16 of the cover 13. It is preferred that the length of threaded engagement (19–20) shall be for an integer number of full turns, for both of the possible engaged orientations of the flywheel component 11.

FIGS. 6 and 7 reveal in greater detail the nature of interconnecting profiles of recess formations in the otherwise flat upper surface of the container base 12. These profiles may be described as diametrically opposed cylindrically arcuate walls 30–30', to a first depth $D_1$ for centrally localized retention of the flywheel component 11, complete with its elastomeric outer ring 27. Two like straight grooves 31-31', to a slightly greater depth $D_2$, are in diametrically opposite parallel array, within the base annulus surrounding the geometric circle of walls 30-30'; and at depth $D_1$, bridging groove walls 32—32' with rounded outer ends 33—33' complete the definition of the single parts-retaining recess formation. The length of each of the straight grooves 31- 31'is such as to separately accommodate the tool 14 and spindle 10, the greater depth $D_2$ being sufficient to receive spindle hub 17 without interference with the flat surface of recess 15, when cover 13 is in place over the disassembled and separately retained parts.

FIG. 10 shows an alternative spindle component 10' having a lower end 35 of spherical radius less than reduced cylindrical portion 36 to which it is formed. Also in FIG. 10, a frusto-conical taper 37 of slope matching the slope of the chamfers of the flywheel bore, enables the secured assembly to be self-centering via matching tapers, whether the flywheel 11 is assembled in its FIGS. **4*b*** orientation, or in the inverted relation described above.

It will be seen that the described invention meets all stated objects. A particularly satisfying and attractive business toy results from first-class machining and finishing of stainless steel for spindle 10 and tool 14, brass for the body of flywheel 11, neoprene for the O-ring 27, and polished oak, walnut or other sufficiently hard, attractively grained wood for the two container parts 12–13. Competing top-spinning skills can be evaluated in terms of timed spinning duration, for each of the described assembly relationships. And ultimate skills are evaluated by timed spinning duration for the circumstances of inverting the spindle so as to drive spinning support from the upper end, with the flywheel 11 as far as possible above the point of spinning support.

While the invention has been described in detail for preferred embodiments, it will be understood that modifications may be made without departing from the scope of the invention. For example, for the two-part container as thus-far described, it is optional whether the fit of cover 13 to base 12 is relatively loose or is a friction fit. Certainly, as an executive toy, it is arguably more convenient that the fit be loose, thus allowing the base and any of its contents to rest on a desk top while the cover is selectively removed for purposes of removing or replacing tool 14 or spinning-top parts 10–11. For a friction fit, a slight taper or other contouring of the convex circumferential outer wall of base 12 may be a sufficient lightly wedging fit to the concave circumferential wall of recess 15 in cover 13. Alternatively, and as suggested by like diametrically opposed phantom outlines 40-40' in FIG. 1, generally L-shaped arcuate cuts in the material of base 12 may establish compliantly cantilevered friction fingers 41-41' which can have friction-retaining compliant interference with the concave circumferential wall of recess 15, upon cover 13 assembly to base 12; the friction-engagement in such case is selectively releasable by manual squeeze of fingers 41-41' toward each other, as suggested by diametrically opposed arrows M-N in FIG. 1.

Still further alternatively, and as illustrated in FIGS. 11 to 13, the two parts 112/113 of the container may be permanently assembled to each other, with provision for eccentrically pivoted offset of their connection, in order to access or return components 10-11-14 at their respective locating recess formations. In FIG. 11, the cover member 113 is formed with an upper surface that is a concave dish 116. The pivotal connection is seen in FIG. 13 to rely upon a stud 150 fixedly and eccentrically embedded in cover 113, near the periphery thereof. Stud 150 passes freely through a guide bore 151 in base member 112, and the enlarged head of stud 150 is freely accommodated in a counterbore 152, subject to the preloading force of a compression spring 153 that is captive between the stud head and a washer at the inner end of the counterbore 152. When the container parts are pivoted into coaxial registration, the flat upper surface of base member 112 is resiliently held and located against the shallow flat bottom surface 115 in the underside of cover member 113, the relatively shallow depth being indicated at d in FIG. 11. Preferably, the upper peripheral edge of base member 112 is chamfered, and in the described seated relation of parts 112/113, this chamfer nests in a concave chamfer-engaging flare of the recess 115 on the underside of cover member 113. When opening the container, the chamfer-to-flare relation will be understood to cam the cover 113 upward against compression-spring action so that in the course of pivoting the cover about the stud axis, the periphery of the underside of the cover will ride upon the flat upper surface of base member 112. Having had access to container contents, cover 113 is swung back into coaxial registry with base member 112, at which point spring 153 snaps the parts into effective detent retention of the coaxial relation.

FIGS. 11 and 12 also show slight modification of the wrench-pin retaining groove 154 for base member 112, being shown both more narrow and more shallow than in the case of FIG. 1, for neater orientation of wrench pin 14, when stowed. FIG. 11 also shows several grooves 130–133, into which the spindle and flywheel are placed.

What is claimed is:

1. A spin-top comprising an elongate metal spindle having semispherical upper-end and lower-end profiles, said spindle having an enlarged hub portion between and offset from both end profiles, the lower end of said hub terminating in a downwardly facing radial shoulder, and said spindle having an externally threaded portion beneath and adjacent said shoulder and at relatively short offset from the lower end of said spindle; and a flywheel having an internally threaded bore, said flywheel being removably engaged via said bore to the threaded portion of said spindle, said flywheel having an outwardly facing circumferential groove with an elastomeric O-ring fitted to said groove, and said semi-spherical lower-end profile projecting beyond said flywheel when the latter is threaded into abutment with said shoulder, the extent of both spindle-end profile projections axially beyond said flywheel being such as to dictate non-spinning support of the top soley via said O-ring and either of the ends of said spindle.

2. The spin-top of claim 1, in which the spindle is of stainless steel.

3. The spin-top of claim 1, in which the flywheel is of brass.

4. The spin-top of claim 1, in which the angle of spindle axis orientation with respect to a normal to a flat surface in an at-rest condition of the top is in the order of 20 degrees, for the case of at-rest support via one of the ends of said spindle.

5. The spin-top of claim 1, in which said hub portion has a diametrically extending transverse bore providing an opening for wrenching access to said spindle.

6. The spin-top of claim 1, in which said hub portion tapers inwardly in the direction of the upper end of the spindle and is substantially contained within the lower longitudinal half of the spindle, the upper end of the spindle being of reduced cylindrical diameter and substantially contained within the upper longitudinal half of the spindle.

7. The spin-top of claim 6, in which the upper end of the spindle is further characterized by a plurality of axially spaced circumferentially continuous peripheral grooves.

8. The spin-top of claim 1, in which said flywheel is of axial thickness which is at least as great as the thickness of said O-ring.

9. The spin-top of claim 1, in which said flywheel is characterized by a substantially flat lower surface and by an upper surface which is at maximum thickness offset from said lower surface both at a central hub region of shoulder engagement and at a peripheral region of O-ring retention, said upper surface being recessed to define an annular web region between said hub region and said peripheral region.

10. The spin-top of claim 9, in which a first frusto-conical transition zone connects said web region to said hub region and a second frusto-conical transition zone connects said web portion to said peripheral region.

11. As an article of manufacture, a spin-top kit comprising a flywheel component, a spindle component, a wrench component, and a two-part container for said components when said components are separated, said container comprising a base part having a flat upper surface that is locally recessed for the separate localized accommodation of said components, and a relatively thin circular cover part having a lower surface that is recessed for removable closing fit over said base part, said cover part having a concave upper surface which extends to at least substantially the peripheral region of said cover part, and said concave upper surface providing a self-limiting area for a spinning run of the top formed by assembly of said spindle and flywheel components.

12. The kit of claim 11, in which the radius of curvature of the upper surface of said cover part is approximately twice the diameter of said cover part.

13. The kit of claim 11, in which the length of said spindle component approximates the radius of the periphery of said cover part.

14. The kit of claim 11, in which the thickness of said base part exceeds the depth of the recess in the lower surface of said cover part, and in which the removably engageable surfaces are substantially cylindrical and friction-engaged at closure of the container, whereby, with the container closed, said concave surface may be elevated above a supporting desk or other horizontal supportive surface for self-retaining spin-top play upon the concave surface, and further whereby firm grasping access is available to both container parts for elective separable assembly of said container parts.

* * * * *